US005660359A

United States Patent [19]

Lurie et al.

[11] Patent Number: 5,660,359

[45] Date of Patent: Aug. 26, 1997

[54] DEVICE FOR ELIMINATING AIR FROM A NURSING BOTTLE

[75] Inventors: George S. Lurie, 130 Buckminster Rd., Brookline, Mass. 02146; Keith D. Patterson, Providence, R.I.

[73] Assignee: George S. Lurie, Brookline, Mass.

[21] Appl. No.: 366,495

[22] Filed: Dec. 30, 1994

[51] Int. Cl.[6] ..... A47D 15/00

[52] U.S. Cl. ..... 248/105

[58] Field of Search ..... 248/105; 211/74, 211/57.1, 59.1; 215/11.1, 11.3, 11.6, 392, 393, 395; 222/95, 386.5, 320

[56] References Cited

U.S. PATENT DOCUMENTS

| | | | |
|---|---|---|---|
| 539,264 | 5/1895 | Hall | 211/76 X |
| 2,016,097 | 10/1935 | Parson | 211/87 |
| 2,670,085 | 2/1954 | Sorrentino | 211/59.1 |
| 3,134,494 | 5/1964 | Quinn | 215/11.3 |
| 3,221,891 | 12/1965 | Snow | 211/87 X |
| 3,648,873 | 3/1972 | Grobbel . | |
| 3,822,806 | 7/1974 | Grimer | 215/11.3 |
| 4,101,044 | 7/1978 | Paguette et al. | 215/393 X |
| 4,726,553 | 2/1988 | Wischuser, III | 215/393 X |
| 4,796,767 | 1/1989 | McKeown . | |
| 4,880,125 | 11/1989 | LeBeau . | |
| 4,979,629 | 12/1990 | Askerneese . | |
| 5,033,631 | 7/1991 | Nightingale . | |
| 5,109,996 | 5/1992 | Sullivan . | |

*Primary Examiner*—Leslie A. Braun
*Attorney, Agent, or Firm*—Steven N. Fox, Esq.

[57] ABSTRACT

Disclosed is a device for use with a nursing bottle having an inner bag. In one embodiment, the device comprises a base member and a first member extending from the base member and adapted to engage with the inner bag of the nursing bottle. The device further comprises a second member extending from the base member and adapted to support the nursing bottle during feeding. The base member is formed with a lip portion which surrounds the first and second members. In operation, a person feeding an infant may support the nursing bottle upon the second member while filing the nursing bottle with baby formula. Thereafter, the person may remove the nursing bottle from the second member and engage the nursing bottle with the first member to eliminate air from the inner bag of the nursing bottle. This is accomplished by pushing the nursing bottle downward along the first member. Any spillage overflow of the baby formula resulting from filling the nursing bottle or eliminating air from the nursing bottle is retained within the base member by the lip portion.

4 Claims, 3 Drawing Sheets

DEVICE FOR ELIMINATING AIR FROM A NURSING BOTTLE

FIELD OF THE INVENTION

The present invention relates generally to devices for use with infants. More specifically, the present invention relates to a device for use when feeding infants with a nursing bottle.

BACKGROUND OF THE INVENTION

The use of nursing bottles for feeding infants is well known. The vast majority of nursing bottles have a rigid housing and a flexible nipple which extends through the housing to a flexible container or lining which retains a baby formula or other liquid to be ingested by the infant. One problem associated with the use of such nursing bottles is that during feeding air may pass through the nipple and become trapped within the inner lining to replace any fluid which has been removed from the nursing bottle. Thereafter, the air can be ingested by the infant as feeding continues thereby causing discomfort to the infant which is often solved by a procedure which is commonly referred to as "burping."

SUMMARY OF THE INVENTION

The primary object of the present invention was to develop a device to remove unwanted air from a nursing bottle which uses a flexible container or lining which retains baby formula.

Another object of the present invention was to develop a device to remove unwanted air from a nursing bottle which could be easily operated by a person using a single hand.

Another object of the present invention was to develop a device to support a nursing bottle in an upright position such as may be desired, for example, when filling the nursing bottle with baby formula or otherwise having to store the nursing bottle while attending to the infant.

The present invention is device for use with a nursing bottle having a flexible inner container or bag. In one embodiment, the device generally comprises a base member and first and second members. The first member extends from the base member and is adapted to engage with the inner bag of the nursing bottle. The second member also extends from the base member and is adapted to support the nursing bottle. The base member is formed with a lip portion which surrounds the first and second members. In operation, a person feeding an infant may support the nursing bottle upon the second member while filling the nursing bottle with baby formula. Thereafter, the person may remove the nursing bottle from the second member and engage the nursing bottle with the first member to eliminate unwanted air from the inner bag of the nursing bottle. This may be accomplished by pushing the nursing bottle downward along the first member. Any spillage or overflow of the baby formula resulting from filling of the nursing bottle or eliminating air from the nursing bottle is retained within the base member by the lip portion.

BRIEF DESCRIPTION OF THE DRAWINGS

The following detailed description of the present invention will be more fully understood with reference to the accompanying drawings in which.

DETAILED DESCRIPTION OF THE PREFERRED EMBODIMENT

Figure 1:
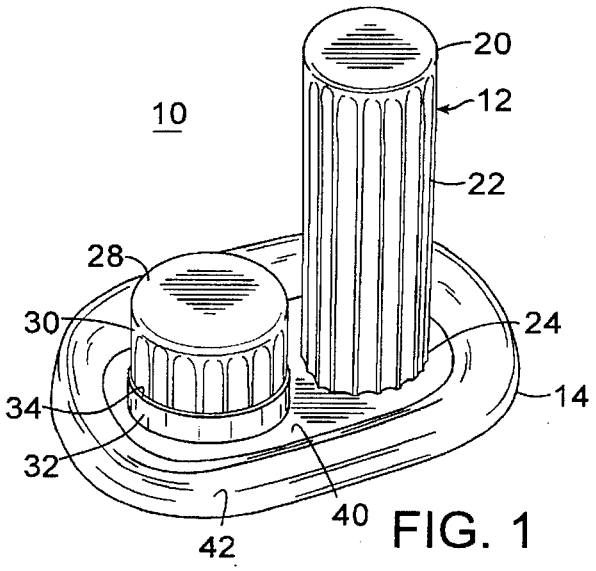
FIG. 1 is a perspective view of the present invention.
Figure 2:
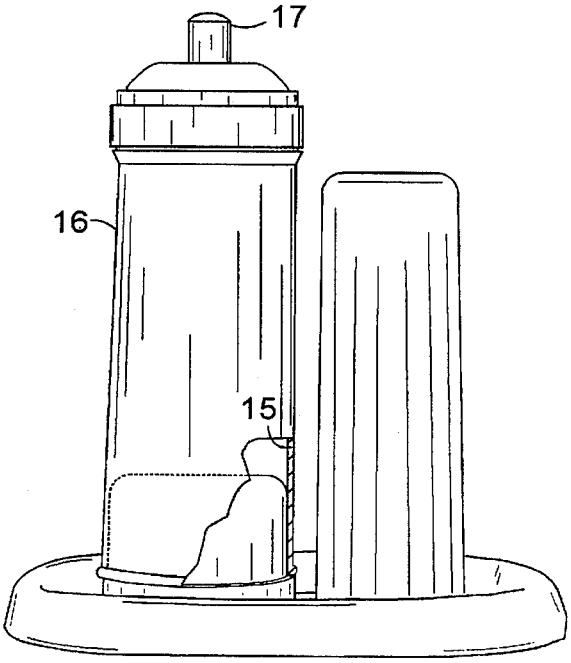
FIG. 2 is a plan view of the present invention showing a nursing bottle positioned thereon.
Figure 3:
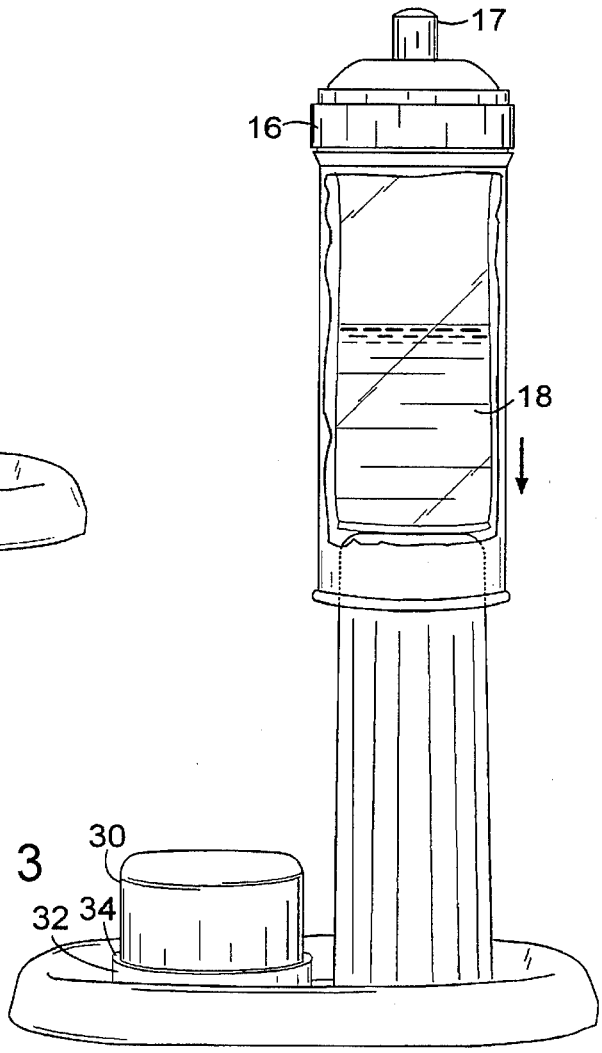
FIG. 3 is a plan view the of present invention showing a nursing bottle positioned thereon.
Figure 4:
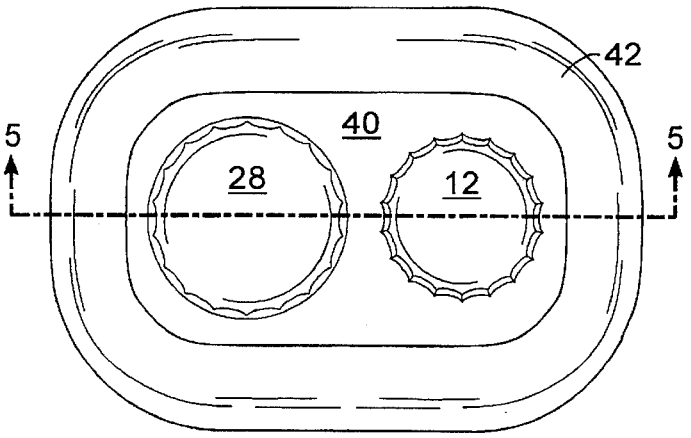
FIG. 4 is top plan view of the present invention.
Figure 5:
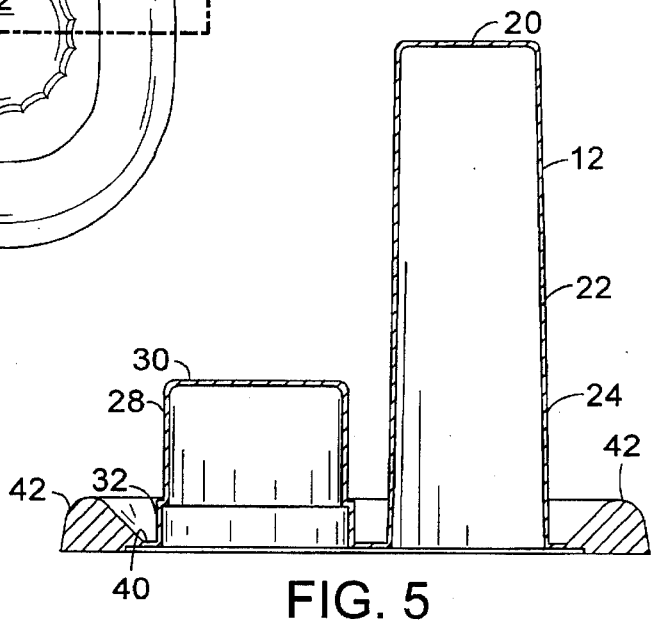
FIG. 5 is a cross-section view taken along line 5—5 of FIG. 4.
Figure 6:
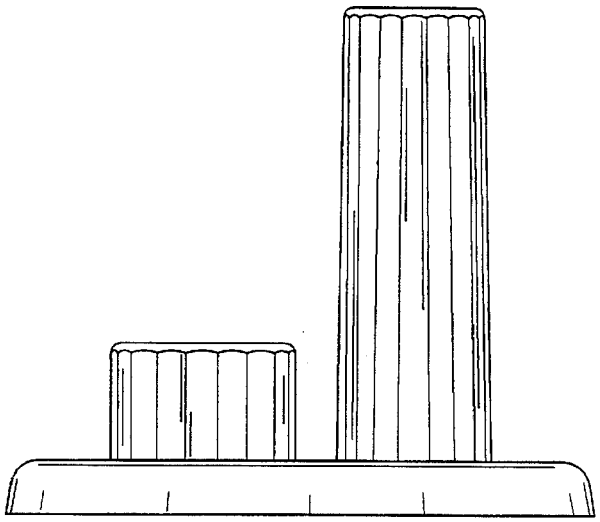
FIG. 6 is a front view of the ornamental design of the present invention.

Referring to FIGS. 1–6, where the device 10 of the present invention is shown generally comprising a first member 12 extending from a base 14. The first member 12 is generally adapted to engage with a nursing bottle 16 having for example a rigid housing wall 15, a flexible nipple 17, and a flexible inner liner or bag 18.

The first member 12 is of generally cylindrical shape and comprises an upper portion 20, a median portion 22, and a bottom portion 24 which is mounted or may be integral with the base 14. The nursing bottle 16 having fluid contained within the inner bag 18 may be placed over the top of the upper portion 20 and pushed downward. As the nursing bottle 16 is pushed downward, the first member 12 engages with the inner bag 18 and causes the same to be pushed upward whereby any air contained within the inner bag 18 is expelled through the nipple 17. Thereafter, the nursing bottle 16 may be used to continue feeding the infant. Although the first member 12 preferably extends perpendicular to the base member 14, the first member 12 may extend from the base member 14 in a non-perpendicular position. The overall diameter of the first member 12 should be chosen such that the nursing bottle 16 may easily slide downward along the first member 20. However, the diameter should also be large enough to cover a substantial portion of the surface area of the inner bag 18 to prevent the same from becoming caught between the nursing bottle 16 and the first member 12 as the nursing bottle 16 is pushed downward. Alternatively, it may be desirable to taper the first member 12. By way of example only, the diameter of the first member 12 may be tapered such that the diameter increases from the lower portion 24 to the upper portion 20.

The device 10 further comprises a second member 28 extending from the base 14 and which is generally adapted to support the nursing bottle 16 in an upright position while filling the nursing bottle 15 or for other general uses either before, during or after feeding of an infant. The second member 28 is generally of cylindrical shape and comprises an upper portion 30 and a lower portion 32 which is mounted to or may be integral with the base 14. The diameter of the upper portion 30 is smaller than the diameter of the lower portion 32 to thereby form a shoulder or support surface 34. The relative diameter of the upper portion 30 and diameter of the lower portion 32 may be chosen based upon inside diameter of the nursing bottle 16 desired 20 to be supported or otherwise stored. By way of example only, nursing bottles having a small diameter may be snugly placed over the upper portion 30 while nursing bottles 16 having a larger diameter may be snugly placed over the lower portion 32.

The base 14 generally comprises an inner portion 40 which is substantially planar and a lip or outer portion 42 which surrounds the inner portion 40. The inner portion 40 and lip portion 42 are designed to retain any liquid or baby formula which may spill from the nursing bottle 16 during filling or expelling of air. In the embodiment shown, the lip portion 42 is designed with a generally convex shape which is tapered to the inner portion 40 whereby any liquid spilling or over-flowing from the nursing bottle 16 will accumulate within the inner portion 40.

The first member 12, second member 28 and the base 14 may be made from a variety of materials which are preferably rigid and easy to clean and dishwasher safe. By way of example only, the first member 12, second member 28 and the base 14 may be made from a plastic material such as polypropylene. Similarly, there are a variety of processes for fabrication of the present invention. In the preferred embodiment, the first member 12, second member 28 and the base 14 are integrally formed by conventional molding processes.

Figure 7:
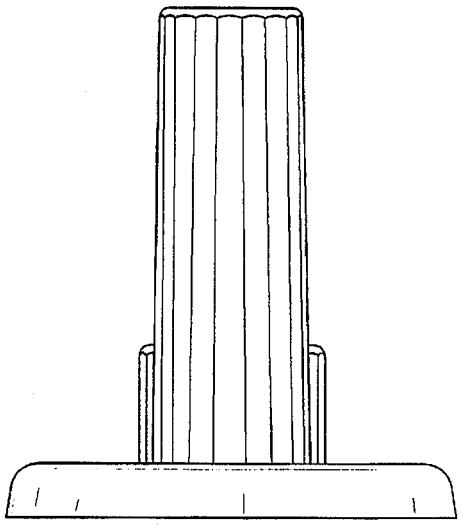
FIG. 7 is a side view of the ornamental design of the present invention.
Figure 8:
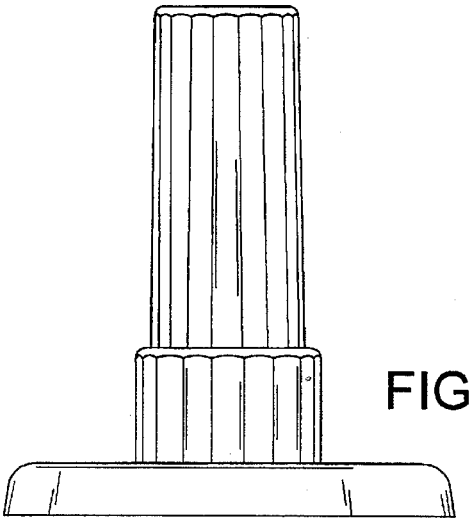
FIG. 8 is a side view of the ornamental design of the present invention.
Figure 9:
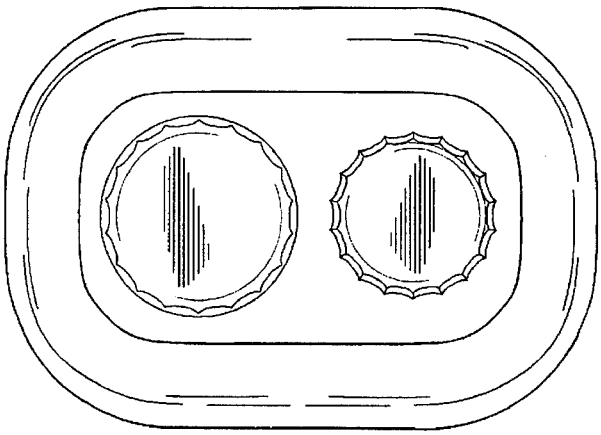
FIG. 9 is a top view of the ornamental design of the present invention.
Figure 10:
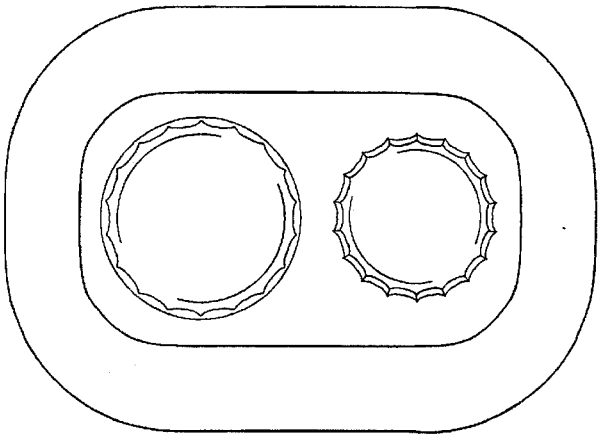
FIG. 10 is a bottom view of the ornamental design of the present invention.

FIGS. 6–10 are views showing the ornamental design of one embodiment of the present invention.

With the device 10 of the present invention, a person may support the nursing bottle 16 in an upright position on the second member 20 during filling or general purposes either before, during and/or after feeding. After filling or when use of the nursing bottle 16 is required, the nursing bottle 16 may be easily removed from the second member 20. Thereafter, and as periodically required, the nursing bottle may be placed upon the first member 12 and pushed downward to remove air trapped within the inner bag 18. Thereafter, the nursing bottle 16 may be used to feed the infant. Any spillage overflow of the baby formula resulting from filling the nursing bottle or eliminating air from the nursing bottle is retained within the base member by the lip portion.

The foregoing description is intended primarily for purposes of illustration. This invention may be embodied in other forms and/or carried out in other ways without departing from the spirit or scope of the invention. Modifications and variations still falling within the spirit or the scope of the invention will be readily apparent to those skilled in the art.

What is claimed:

1. An apparatus comprising:

(a) a nursing bottle comprising an inner bag and an outside annular wall, said annular wall comprising an inside surface and a terminal end; and (b) a base member comprising a support surface and a first member extending from said support surface, said first member having an outside diameter to engage with said inner bag of said nursing bottle, said base member further comprising a second member extending from said support surface, said second member being adapted to support said nursing bottle in a substantially upright position, said base member further comprises a lip portion, said lip portion being higher than said support surface and surrounding said first member, said lip portion being spaced a substantial distance from said first member to allow said first member to be engageable with said inner bag without contact with said lip portion and to retain any fluid spilling from said nursing bottle.

2. The apparatus of claim 1 wherein said second member comprises a first portion and a second portion, said first portion being adapted to engage with said inside surface of said annular wall of said nursing bottle and said second portion being adapted to engage with said terminal end of said annular wall of said nursing bottle.

3. A nursing bottle having an inner bag and an outside annular wall having an inside surface and a terminal end in combination with a device for use with the nursing bottle, the device comprises a base member comprising a support surface and a first member extending from said support surface, said first member having an outside diameter to engage with the inner bag of the nursing bottle, said base member further comprising a second member extending from said support surface, said second member being adapted to support the nursing bottle in a substantially upright position, said base member further comprises a lip portion, said lip portion being higher than said support surface and surrounding said first member, said lip portion being spaced a substantial distance from said first member to allow said first member to be engageable with the inner bag without contact with said lip portion and to retain any fluid spilling from the said nursing bottle.

4. The apparatus of claim 3, wherein said second member comprises a first portion and a second portion, said first portion being adapted to engage with said inside surface of the annular wall of the nursing bottle and said second portion being adapted to engage with the terminal end of the annular wall of the nursing bottle.

* * * * *